United States Patent [19]

Lindner

[11] 4,089,191

[45] May 16, 1978

[54] PATTERNING APPARATUS FOR KNITTING MACHINES, PARTICULARLY FOR MANUFACTURING PATTERNED KNITTED PILE FABRICS ON CROCHETTING MACHINES

[75] Inventor: Heinz Lindner, Geyer, Erzg., Germany

[73] Assignee: VEB Wirkmaschinenbau Karl-Marx-Stadt, Karl-Marx-Stadt, Germany

[21] Appl. No.: 789,600

[22] Filed: Apr. 18, 1977

Related U.S. Application Data

[62] Division of Ser. No. 678,333, Apr. 19, 1976, Pat. No. 4,031,717.

[51] Int. Cl.[2] ..... D04B 23/06; D04B 23/08; D04B 23/10; D04B 23/12

[52] U.S. Cl. ..... 66/84 R

[58] Field of Search ..... 66/154, 204, 203, 205, 66/104, 109, 84 R, 83

[56] References Cited

U.S. PATENT DOCUMENTS

| | | | |
|---|---|---|---|
| 3,707,853 | 1/1973 | Lindner et al. | 66/84 |
| 3,857,260 | 12/1974 | Zwingenberger et al. | 66/84 |
| 3,913,355 | 10/1975 | Lindner | 66/84 |
| 4,031,717 | 6/1977 | Lindner | 66/84 R |

*Primary Examiner*—Ronald Feldbaum
*Attorney, Agent, or Firm*—Nolte and Nolte

[57] ABSTRACT

Patterning apparatus for pile knitting machines for manufacturing patterned knitted pile fabrics on crochetting machines having a row of side-by-side needles, and multiple pile thread guides provided with a pile thread selecting sinker for each needle, the thread exit openings of the multiple pile thread guides being disposed in spaced relationship one to the other along lines substantially in parallel with the longitudinal axes of the needles; the selecting sinkers being supported on a vertically movable bar for pivotal movement about axis parallel to the row of needles to selected thread exit openings of their respective multiple pile thread guide via patterning spacers operable adjacent the upper ends of the sinkers, the sinkers incorporating stop elements on said upper ends operative with stop linkages shared in common by all thread selecting sinkers.

1 Claim, 2 Drawing Figures

Figure 1:
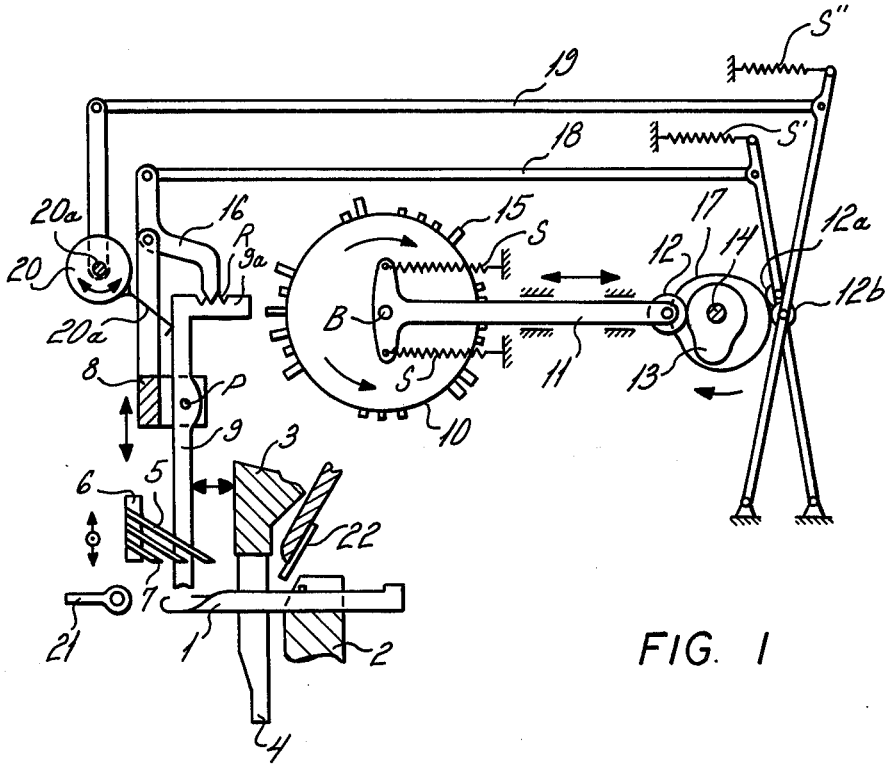

PATTERNING APPARATUS FOR KNITTING MACHINES, PARTICULARLY FOR MANUFACTURING PATTERNED KNITTED PILE FABRICS ON CROCHETTING MACHINES

This is a division of application Ser. No. 678,333 filed Apr. 14, 1976, now U.S. Pat. No. 4,031,717.

BACKGROUND OF THE INVENTION

It is known in the manufacture of patterned pile fabric to place all non-patterned pile threads under a needle movving in alternating directions thereby to bind or tie them into a stationary filling or warp. The knitted pile thread to be patterned is selected by a patterning device and is placed under the adjacent needle and, accordingly, laid across the pile sinkers and is tied off in the adjoining wale, between the needle and the sinker stitch and in the following row of stitches, again in the same manner, in the first wale. The patterned pile threads arrive at the stitch-forming station via a multiple pile thread guide, the thread exit openings of which are arranged in vertically spaced relationship one to the other. The patterning pile thread is selected by a thread selecting sinker movable to each vertical position of the thread exit openings and movable from a position above the needle to below the needle via a pin comb upon which it is mounted and positioned. The thread selecting sinker and the multiple pile thread guide are both moved below the needle which causes the patterning pile thread to be placed under the needle for the purpose of being tied.

The goods produced by this known patterning apparatus have disadvantages since all patterning pile threads are bound only once by the warp thread and the binding is situated on the pile side of the fabric. As a result, the rubber coating which is applied on the backside of the fabric does not reach the binding location uniformly and, therefore, individual strands of the pile thread, or entire pile loops, when cut open, can be easily pulled out.

To eliminate these disadvantages, a device has been suggested which comprises a multiple pile thread guide where the thread exit openings are disposed in spaced relationship in a horizontal plane; that is, substantially parallel to the longitudinal axis of the needle. These guides are provided with vertically movable thread selecting sinkers which are movable to the selected position in the horizontal plane. Such a device makes it possible to place the patterning pile thread into the needle hook and thereby to be able to reliably tie the pile loop on the back side of the fabric. However, the patterning apparatus used for positioning thread selecting sinkers for the first mentioned device cannot be used for the last described device as such apparatus permits only a pattern depending control of the vertical position of the thread selecting sinker while the latter requires selected horizontal placement of the sinker.

It is an object of the present invention to provide a reliable selection of the patterning pile threads from horizontally spaced exit openings of multiple thread guides by employing simple measures.

The object of the invention is to provide a patterning device which will permit, by employing economical, and simple technical procedures, a pattern-depending coordination of the thread selecting sinker with the thread exit openings of the multiple pile thread guide, in which the openings are situated in a horizontal plane, and the insertion of the patterning pile thread into the hooks of the needle.

To this end and in accordance with the invention, the selecting sinkers are supported by a vertically movable bar which extends longitudinally of the knitting machine and laterally of the path of travel of the needles. The sinkers are pivotally connected to the bar approximately at the centers of the sinkers, and are rotatable about their pivotal connection so that their upper ends can be laterally (forwardly and rearwardly) placed in the path of pattern spacers or pattern elements which are adjustable according to the pattern, and so that the other operating ends of the sinkers can be adjusted selectively to one thread exit opening of the multiple pile thread guide. The thread selecting sinkers are provided with means cooperating with controllable stop members to arrest the thread selecting sinkers in their respective swing position and in accordance with the invention such controllable stop members are shared in common by all thread selecting sinkers.

The controllable arresting or stop members in the embodiment of the invention to be described, cooperate preferably with a plurality of recesses, provided on the upper surfaces or edges of the thread selecting sinkers and comprise a single stopping strip, ledge or bar which is movably affixed to the thread selecting sinker supporting bar and is operated via levers or the like by a cam mounted upon the cam shaft of the knitting machine.

A feature of the invention provides that each thread selecting sinker may be moved with and against the action of a leaf spring arranged on a fixed bar which bar is swingable about its axis which extends parallel to the traverse of the needles and which is also operable via levers or the like with the cam supported on the cam shaft of the knitting machine.

In an embodiment of the invention, the pattern spacers may be provided on a pattern carrier which is rotatable to place the spacers in position adjacent the upper ends of the thread selecting sinkers and is movable forwardly in the longitudinal direction of the needles to actuate the sinkers and rearwardly to withdraw the spacers from the actuating position. The thread selecting sinkers, which are swiveled on the sinker support bar and under the influence of leaf springs, thus may cooperate with the movable pattern carrier to be moved thereby and there against. It is contemplated in this embodiment of the invention that the pattern carrier comprises, for example, a Jacquard cylinder carried between two arms which are moved via a cam on the cam shaft of the knitting machine.

In this last respect, however, it is also possible to provide the pattern spacers on a carrier movable only in the vertical direction, a rail being disposed adjacent the upper ends of the all thread selecting sinkers which rail is connected, via a connecting rod or the like, to a cam on the cam shaft, in a manner whereby all thread selecting sinkers under the influence of the rail, against the action of the leaf springs, can be withdrawn from the pattern spacers during the movement of the carrier.

The invention also contemplates that the pattern spacers may form a part of a pattern carrier movable only in the longitudinal direction of the needles.

In accordance with these last features of the invention, the pattern spacers may be formed as steps on an offset pin movable via a conventional Jacquard patternmaking device or the like.

Thus, the invention provides apparatus which reliably selects respective patterning pile threads as well as reliably tying the same into the fabric.

Figure 2:
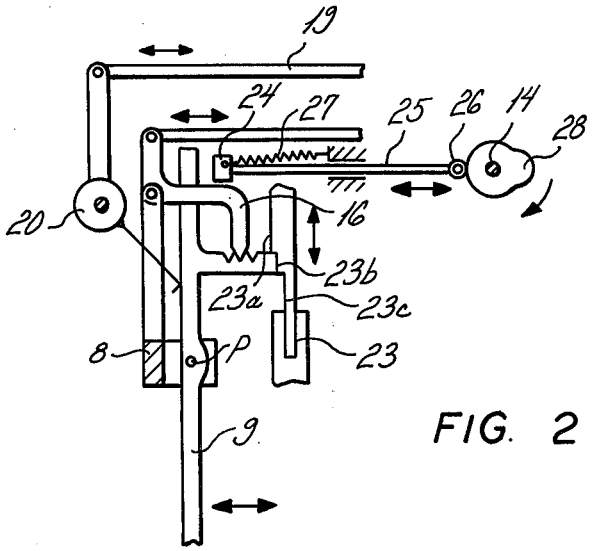

The invention will now be further understood by reference to the following specification taken in conjunction with the accompanying drawings, in which:

FIG. 1 is a cross-sectional view through a stitch-forming station of a crochetting galloon machine provided with the patterning device of the invention and shown in part diagrammatically; and FIG. 2 shows a similar cross section of a modified embodiment of the patterning device of the invention.

The crochetting galloon machine of FIG. 1 is provided with a row of side-by-side slide needles 1, only one of which is shown for simplicity. The needles are movable in the horizontal, forwardly and rearwardly. The slide needles 1 are led in the knock-over comb 2 and penetrate pile sinkers 4 which are affixed to the stationary bar 3. Directly forward of the pile sinkers 4 are the multiple thread guides 5, supported in a bar 6. The bar 6 is movable in vertical direction, as well as sideways, in the direction of the row of needles. The thread exit openings 7 of the multiple pile thread guides 5 are horizontally spaced. Above each multiple pile thread guide 5, one thread selecting sinker 9, respectively, is disposed on a common guide bar 8 which is movable only in the vertical direction. In its upper position, the lower, operative end of the thread selecting sinker 9 is situated above the multiple thread guide 5. The thread selecting sinker 9 is pivotally supported on the bar 8, as at P, approximately in the middle of the sinker, so that its lower end is, selectively, adjustable to overlie one of the thread exit openings 7. To this end, a patterning drum 10 which can be moved forwardly and rotated about its bearing B is situated rearwardly of the upper ends of the thread selecting sinkers 9 which are provided with rearwardly extending spacer-contact arms 9*a*. The drum 10 is mounted on two arms 11 which are movable forwardly and rearwardly under the influence of tension springs S, and receive their translating movement, via the race rollers 12, from the cam 13 of a rotating shaft 14. Due to this movement which is transmitted to the patterning drum, the selecting sinkers 9 may be influenced with respect to their swinging movement about their pivotal mountings P by the pattern elements 15 of the drum 10, the pattern elements being positioned via the rotational movement, clockwise and counter-clockwise of the drum 10.

The sinkers 9 may be locked in the selected swing position, by means of the lock lever 16. The lock lever 16 is controlled, by the action of another cam 17 of the shaft 14, via race roller 12*a*, and linkages 18 under the influence of tension springs S'.

Against the cam 17 bears race rollers 12*b* and linkages 19 which, under the influence of tension spring S'', serves to control the spring bar 20, which is fixedly mounted on rotatable shaft 20*a*. Also shown in FIG. 1 are the conventional warp thread bearings 21 and the layering or filling thread members 22 which are needed for forming stitches.

At the beginning of the work cycle, the lower end of the thread selecting sinker 9 is situated above a thread exit opening 7 of the desired pattern-making pile thread. The guide bar 8 is lowered and the thread selecting sinker 9 grasps the desired pile thread and presses the same onto the shaft of the needle 1.

During the ensuing backward knock-over motion of the needle 1, the needle also grasps with the needle hook the pattern-making pile thread and forms it into a loop or stitch.

After the pattern-making pile thread has been tied, the thread selecting sinker support bar 8 moves upwardly and the thread selecting sinker can be newly adjusted according to the pattern.

The lock lever or as it may be called, the stop lever, 16 is withdrawn from a recess R on arm 9*a* by the short side of the cam 17 and spring S', pushing the top of lever 16 rearwardly via linkages 18 at the time when the bar 8 is in its upward position. This releases the thread selecting sinker 9. Subsequently, the rearwardly extending contact arms 9*a* of the thread selecting sinkers 9 are pressed against the pattern-making drum 10 with the assistance of the springs 20*a* of the spring bar 20 which is also controlled by the cam 17, via linkage 19. Thereafter, the drum 10 is placed into its forward operative position, by the cam 13 against which abut the race rollers 12 of the arms 11. At the same time, the thread selecting sinkers 9 are swung, according to the pattern elements 15 or lack thereof in accordance with the position of the circumference of the drum 10, into one of the three desired positions and, thereafter, locked in the selected position by the lever 16 which is lowered by the long side of cam 17 via linkages 18 and spring S'.

As long as the bar 8 remains in its raised position, the pile thread guide 5 can perform its movement or movements fore, aft and sideway. After this movement by the pile thread guide 5 is completed, the lower end of the thread selecting sinker 9 is again situated above the thread exit opening 7 of the desired pattern-making pile thread and the work cycle can be renewed.

In a preferred use of the pattern-making device of the invention, the tying or binding of the non-pattern-making pile threads is effected in a known manner in a wale of the fabric, i.e., non-pattern-making pile threads are placed under the respective needle 1, alternating from one row of stitches to the other row of stitches, and, in this manner, tied between the needle and sinker stitch, while the pattern-making pile threads are first developed into a loop during the following machine passage in the immediately adjacent wale. As a result, the selection of the pattern-making pile threads is selected only during each second machine passage and, therefore, the speed of the shaft 14 is reduced, preferably by 1:2, compared to the main drive shaft of the warp knitting machine.

In another embodiment of the invention shown in FIG. 2, the Jacquard drum 10 is replaced by an offset pin 23 which is adjustable to various vertical levers thereby placing the steps 23*a*, 23*b*, 23*c* in horizontal position to effect movement of the selector sinker 9*a*. Vertical movement of the pin may be accomplished through any desired mechanical or electromagnetic pattern-making device. This can be done, for example, by a Jacquard device with harness threads, which is known in connection with looms. Since the pin 23 is movable only in vertical direction, the thread selecting sinkers 9*a* must be disengaged from the pins 23 during the movement of the pins 23. For this purpose a rail 24 is provided, which is operated against the action of the spring 27 by a cam 28 of the shaft 24, via a connecting bar 25 with racer roller 26, which rail 24 bears against all thread selecting sinkers 9*a* and disengages them from the pin 23 during the movement of the pin 23, element 16 having been moved upwardly via bar 8.

The steps of the offset pin are spaced vertically. Similarly, a horizontally operative offset pin, not shown, with steps offset horizontally can be provided.

The invention has been described with reference to specific embodiments thereof but is not limited thereto. Rather, it is limited only to the following claims.

What is claimed is:

1. In a pattern-making device for a pile knitting machine for manufacturing patterned knitted pile fabrics, the knitting machine being of the type having a row of needles which move fore and aft and multiple pile thread guides movable between the needles, thread selecting sinkers controlled according to the desired pattern by patterning means, the thread exit openings of said multiple pile thread guide being disposed in a plane substantially parallel to the longitudinal axes of the needles, the improvement comprising means mounting the thread selecting sinkers for vertical movement perpendicular to the longitudinal axes of the needles, said mounting means including means for pivotal movement of the thread selecting sinkers intermediate the ends thereof about axes parallel to the row of needles, varying pattern spacer means positioned adjacent the thread selecting sinkers and constituting means for moving said thread selecting sinkers about their pivotal mounting means and for positioning the lower ends of said thread selecting sinkers adjacent any selected one thread exit opening of the multiple pile thread guide, and means for locking the thread selecting sinkers in a respective selected position relative to the corresponding exit openings of the multiple pile thread guides.

* * * * *